US009049522B2

(12) United States Patent
Lee et al.

(10) Patent No.: US 9,049,522 B2
(45) Date of Patent: Jun. 2, 2015

(54) PIEZOELECTRIC MICROSPEAKER AND METHOD OF FABRICATING THE SAME

(75) Inventors: Joo-Ho Lee, Hwaseong-si (KR); Dong-Kyun Kim, Suwon-si (KR); Sang-Hun Lee, Seoul (KR); Seok-Whan Chung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 358 days.

(21) Appl. No.: 13/169,408

(22) Filed: Jun. 27, 2011

(65) Prior Publication Data

US 2012/0087522 A1 Apr. 12, 2012

(30) Foreign Application Priority Data

Oct. 8, 2010 (KR) ..... 10-2010-0098406

(51) Int. Cl.
*H04R 25/00* (2006.01)
*H04R 17/00* (2006.01)

(52) U.S. Cl.
CPC ..... *H04R 17/005* (2013.01); *H04R 2201/003* (2013.01)

(58) Field of Classification Search
USPC ..... 381/114, 173, 190
See application file for complete search history.

(56) References Cited

U.S. PATENT DOCUMENTS

| | | | | |
|---|---|---|---|---|
| 5,770,799 | A * | 6/1998 | Nakamura et al. | 73/514.34 |
| 6,857,501 | B1 * | 2/2005 | Han et al. | 181/158 |
| 7,579,753 | B2 * | 8/2009 | Fazzio et al. | 310/324 |
| 7,812,505 | B2 | 10/2010 | Lee et al. | |

FOREIGN PATENT DOCUMENTS

| | | | |
|---|---|---|---|
| JP | 2007-228539 | A | 9/2007 |
| KR | 10-0416158 | B1 | 1/2004 |
| KR | 10-0870148 | B1 | 11/2008 |
| KR | 10-0931575 | B1 | 12/2009 |

* cited by examiner

*Primary Examiner* — Davetta W Goins
*Assistant Examiner* — Amir Etesam
(74) *Attorney, Agent, or Firm* — Sughrue Mion, PLLC

(57) ABSTRACT

A piezoelectric microspeaker and a method of fabricating the same are provided. The piezoelectric microspeaker includes a substrate having a through hole therein; a diaphragm disposed on the substrate and covering the through hole; and a plurality of piezoelectric actuators including a piezoelectric member, a first electrode, and a second electrode, wherein the first and second electrodes are configured to induce an electric field in the piezoelectric member. The piezoelectric actuators include a central actuator, which is disposed on a central portion of the diaphragm and a plurality of edge actuators, which are disposed a predetermined distance apart from the central actuator and are formed on a plurality of edge portions of the diaphragm.

13 Claims, 10 Drawing Sheets

PIEZOELECTRIC MICROSPEAKER AND METHOD OF FABRICATING THE SAME

CROSS-REFERENCE TO RELATED APPLICATION

This application claims priority under 35 U.S.C. §119(a) from Korean Patent Application No. 10-2010-0098406, filed on Oct. 8, 2010, in the Korean Intellectual Property Office, the entire disclosure of which is incorporated herein by reference for all purposes.

BACKGROUND

1. Field

The following description relates to a microspeaker, and more particularly, to a piezoelectric microspeaker.

2. Description of the Related Art

The piezoelectric effect is the reversible conversion of mechanical energy into electrical energy using a piezoelectric material. In other words, the piezoelectric effect is a phenomenon in which an electric potential difference is generated when pressure or vibration is applied to a piezoelectric material, and the piezoelectric material deforms or vibrates when an electric potential difference is applied. Piezoelectric speakers are acoustic devices that generate sounds by applying an electric field to a piezoelectric material to cause the material to deform or vibrate.

The miniaturization of electronic devices, and similar trends, has led to the need for small, thin acoustic devices. Promising research has been conducted in the area of Micro Elector Mechanical System (MEMS) acoustic devices. Piezoelectric microspeakers, which are a type of MEMS acoustic devices, can be driven at lower voltages than electrostatic microspeakers. In addition, piezoelectric microspeakers have a simpler structure than electromagnetic microspeakers and can thus be easily miniaturized. However, piezoelectric microspeakers have lower power output than conventional voice coil microspeakers, and thus have not yet been employed extensively in mobile electronic devices such as mobile terminals.

SUMMARY

The following description relates to a piezoelectric microspeaker which can maintain high power output even after a long use and a method of fabricating the piezoelectric microspeaker.

According to an aspect of an exemplary embodiment, there is provided a piezoelectric microspeaker including a substrate configured to have a through hole; a diaphragm configured to be disposed on the substrate and cover the through hole; and a plurality of piezoelectric actuators each configured to include a piezoelectric member and first and second electrodes which induce an electric field into the piezoelectric member, wherein the piezoelectric actuators include a central actuator, which is formed on a central portion of the diaphragm and a plurality of edge actuators, which are a predetermined distance apart from the central actuator and are formed on a plurality of edge portions of the diaphragm.

According to an aspect of another exemplary embodiment, there is provided a method of fabricating a piezoelectric microspeaker, the method including forming a first insulating layer on a substrate; forming a central actuator on a central portion of the first insulating layer and a plurality of edge actuators on a plurality of edge portions of the first insulating layer, the edge actuators being a predetermined distance apart from the central actuator, and each of the central actuator and the edge actuators including a piezoelectric member and first and second electrodes which induce an electric field into the piezoelectric member; removing portions of the first insulating layer exposed between the central actuator and the edge actuators; forming a second insulating layer on the substrate along the profile of the piezoelectric actuators; and forming a through hole by etching the substrate.

According to an aspect of another exemplary embodiment, there is provided a piezoelectric microspeaker including a substrate configured to include a through hole; a diaphragm configured to be disposed on the substrate and cover the through hole, the diaphragm being divided into a plurality of actuating portions and a plurality of non-actuating portions, which are formed of different dielectric materials; and a plurality of piezoelectric actuators configured to be formed on the actuating portions, each of the piezoelectric actuators including a piezoelectric member and first and second electrodes which induce an electric field into the piezoelectric member, wherein the actuating portions include a central portion corresponding to the center of the through hole and a plurality of edge portions a predetermined distance apart from the central portion and the non-actuating portions correspond to a plurality of portions between the central portion and the edge portions.

BRIEF DESCRIPTION OF THE DRAWINGS

The above and/or other aspects will become apparent and more readily appreciated from the following description of embodiments, taken in conjunction with the accompanying drawings, in which.

DETAILED DESCRIPTION

Figure 1:
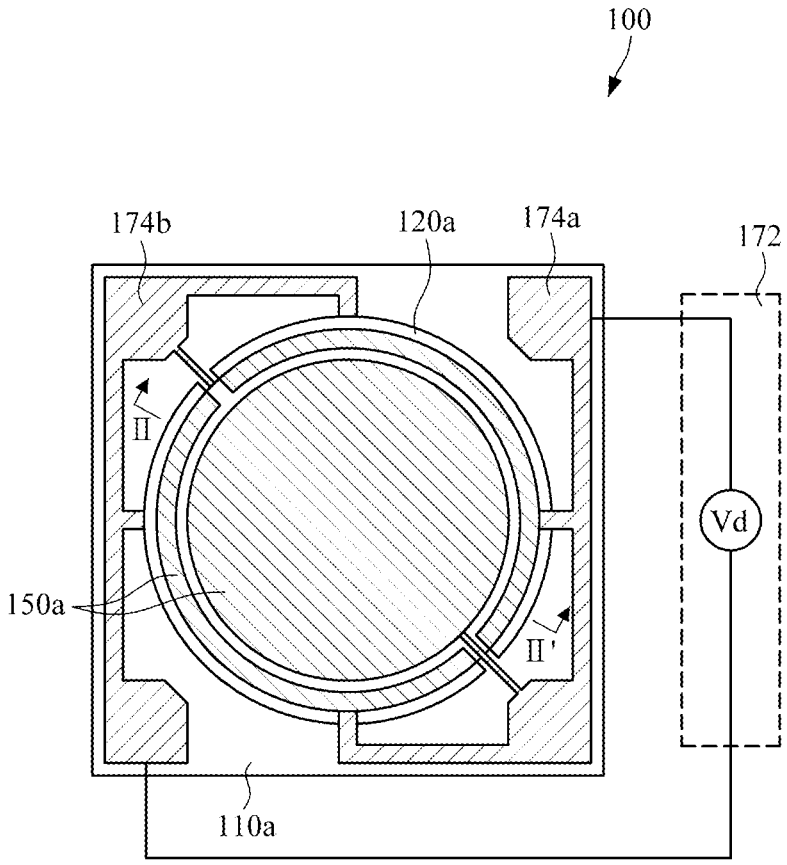
FIG. 1 is a diagram illustrating a piezoelectric microspeaker according to an embodiment.

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Throughout the drawings and the detailed description, unless otherwise described, the same drawing reference numerals will be understood to refer to the same elements, features, and structures. The relative size and depiction of these elements may be exaggerated for clarity, illustration, and convenience.

Figure 2:
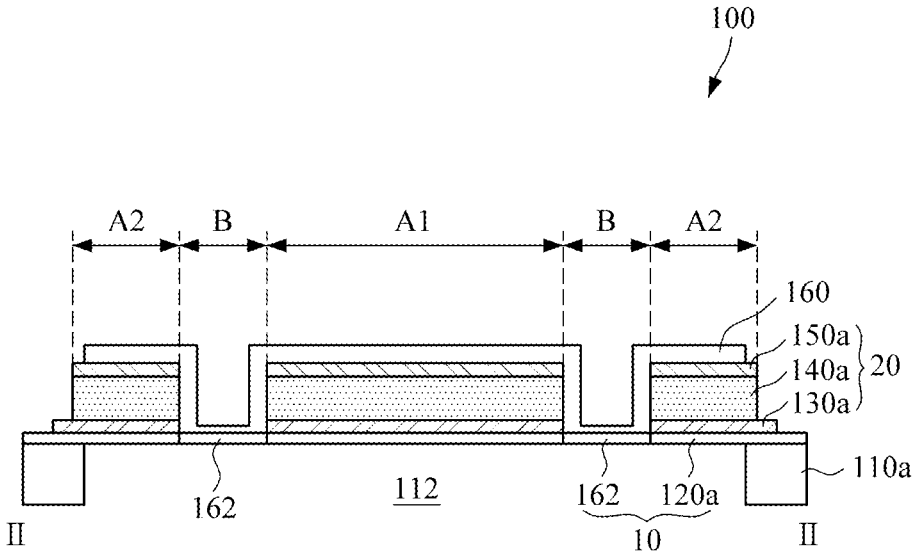
FIG. 2 is a cross-sectional view taken along line II-II' of FIG. 1.

FIG. 1 is a diagram illustrating a piezoelectric microspeaker 100 according to an embodiment, and FIG. 2 is a cross-sectional view taken along line II-II' of FIG. 1. Referring to FIGS. 1 and 2, the piezoelectric microspeaker 100 may include a substrate 110*a*, a diaphragm 10, and a plurality of piezoelectric actuators 20. The piezoelectric microspeaker 100 may also include a power unit 172, a pair of first and second electrode pads 174*a* and 174*b*, and a polymer membrane 160.

The substrate 110*a* may be a typical silicon (Si) substrate, but it is not restricted to this. That is, various types of substrates suitable for the fabrication of a piezoelectric microspeaker, other than a Si substrate, can be used as the substrate 110*a*. A through hole 112 may be formed through the substrate 110*a*. The through hole 112 may provide space for the vibration of the diaphragm 10. There is no specific limit on the size of the through hole 112. The size of the through hole 112 may be freely determined based on the size and the desired power output and resonant frequency of the piezoelectric microspeaker 100.

The diaphragm 10 may be a combination of a plurality of insulating portions and may cover at least the through hole 112. More specifically, the diaphragm 10 may be divided into a plurality of piezoelectric actuating portions 120*a*, which are formed of first insulating portions and on which the piezoelectric actuators 20 are formed; and a plurality of piezoelectric non-actuating portions 162, which are formed of second insulating portions and correspond to portions of the diaphragm 10 between the piezoelectric actuators 20. The diaphragm 10 may be a thin-film structure that generates sonic pressure by being displaced in the direction of its thickness due to the deformation of a piezoelectric member 140*a*.

The piezoelectric actuating portions 120*a* may include a central portion disposed in a region A1, which corresponds to the center of the through hole 112, and a plurality of edge portions disposed in edge regions A2, which are a predetermined distance apart from the central region A1. The piezoelectric actuators 20 may be formed on the piezoelectric actuating portions 120*a*, but not on the piezoelectric non-actuating portions 162. The area of the central portion in the region A1 may be smaller than the through hole 112. Since the central portion in the region A1 is not placed in direct contact with the substrate 110*a*, the central portion in the region A1 can move freely without being restrained by the substrate 110*a*. On the other hand, the edge portions in the regions A2 may be formed as cantilever-like structures having only outer circumferential sides fixed onto the substrate 110*a*, and thus, inner circumferential sides of the edge portions in the regions A2 may be free to move or vibrate. For example, the edge portions in the regions A2 may be a predetermined distance apart from the central portion A1, and may form a ring shape around the central portion in the region A1. The edge portions in the regions A2 may not necessarily need to be formed in one body. Rather, for a proper electric connection, a plurality of edge portions in the regions A2 may be formed. Since the central portion in the region A1 and the edge portions in the regions A2 are separate from each other, the diaphragm 10 can be easily displaced in the direction of its thickness, and this will be described later in further detail.

The piezoelectric actuating portions 120*a* and the piezoelectric non-actuating portions 162 may be formed of different materials. More specifically, the piezoelectric actuating portions 120*a* may be formed of a material having a Young's modulus which is similar to that of the material of the piezoelectric member 140*a*, and the piezoelectric non-actuating portions 162 may be formed of a material having a Young's modulus which is lower than that of the material of the piezoelectric member 140*a*. For example, when the piezoelectric member 140*a* is formed of an aluminum nitride (AlN) layer, a zinc oxide (ZnO) layer or a PbZrTiO (PZT) layer having a Young's modulus of about 50-500 GPa, the piezoelectric actuating portions 120*a* may be formed of silicon nitride having a similar Young's modulus to that of the AlN layer, the ZnO layer or the PZT layer, and the piezoelectric non-actuating portions 162 may be formed of a polymer membrane having a Young's modulus of about 100 MPa-5 GPa. The polymer membrane may be a membrane formed of a polyimide such as parylene, but it is not restricted to this. More specifically, the piezoelectric non-actuating portions 162 may be formed as a polymer membrane that conforms to the shapes of the piezoelectric actuators 20.

The central portion in the region A1 may be formed of a ceramic layer, and the edge portions in the regions A2 and the in-between portions in regions B may be formed of a polymer membrane. In this case, the initial stress of the diaphragm 10 may be lower than that of a diaphragm entirely formed of a ceramic layer, and thus, the diaphragm 10 can provide a higher deformation rate than a diaphragm entirely formed of a ceramic layer. However, polymers generally have a low Young's modulus. Thus, if the diaphragm 10 is entirely formed of a polymer, the equivalent exiting force of the diaphragm 10 may gradually decrease as the number of oscillations of the diaphragm 10 increases. In order to address this problem, the central portion in the region A1 and the edge portions in the regions A2 may be formed of a ceramic layer, and the rest of the diaphragm 10, i.e., the in-between portions in the regions B (the non-actuating portions 162), may be formed of a polymer membrane. That is, since the parts of the diaphragm 10 that are actually displaced are formed of a ceramic layer and the rest of the diaphragm 10 is formed of a polymer membrane, it is possible to prevent, or at least minimize, a decrease in the equivalent exiting force of the diaphragm 10.

Alternatively, the piezoelectric actuating portions 120*a* and the piezoelectric non-actuating portions 162 may be formed of the same material. For example, the piezoelectric actuating portions 120*a* and the piezoelectric non-actuating portions 162 may both be formed of a ceramic layer (such as a silicon nitride layer) or a polymer membrane. In the former case, the fabrication of the piezoelectric actuating portions 120*a* and the piezoelectric non-actuating portions 162 may not necessarily involve etching a first insulating layer, and this will be described later in further detail with reference to FIG. 4D.

Each of the piezoelectric actuators 20 may include a piezoelectric member 140*a* and a pair of electrodes (i.e., lower and upper electrodes 130*a* and 150*a*) which induce an electric field in the piezoelectric member 140*a*. The piezoelectric actuators 20 may be formed on the piezoelectric actuating portions 120*a*, but not on the piezoelectric non-actuating portions 162. The piezoelectric actuators 20 may be divided into a central actuator, which is formed on the central portion in the region A1, and a plurality of edge actuators, which are formed on the edge portions in the regions A2.

More specifically, each of the piezoelectric actuators 20 may include a piezoelectric member 140*a*, which is deformed when an electric field is applied thereto. The deformation of the piezoelectric member 140*a* may cause the diaphragm 10 to be displaced in the direction of its thickness. Each of the piezoelectric actuators 20 may also include a pair of lower and upper electrodes 130*a* and 150*a*, which induce the electric field in the piezoelectric member 140*a*. Each of the piezoelectric actuators 20 may have a stack including the lower electrode 130*a*, a piezoelectric plate 140*a* and the upper electrode 150*a*.

In order to induce an electric field in the piezoelectric member 140*a*, opposite electric potentials may be applied to the lower and upper electrodes 130*a* and 150*a*. More specifically, the electric potential applied to portions of the lower and upper electrodes 130*a* and 150*a* disposed in the central region A1 may be the same as or opposite to the electric potential applied to portions of the lower and upper electrodes 130*a* and 150*a* disposed in edge regions A2. In order to make the electric potential applied to the portions of the lower and upper electrodes 130*a* and 150*a* disposed in the central region A1 and the electric potential applied to the portions of the lower and upper electrodes 130*a* and 150*a* disposed in the edge regions A2 equal, the entire lower electrode 130*a* may be electrically connected to the first electrode pad 174*a*, and the entire upper electrode 150*a* may be electrically connected to the second electrode pad 174*b*. On the other hand, in order to the electric potential applied to the portions of the lower and upper electrodes 130*a* and 150*a* disposed in the central region A1 and the electric potential applied to the portions of the lower and upper electrodes 130*a* and 150*a* disposed in the edge regions A2 opposite to each other, the portion of the lower electrode 130*a* disposed in the central region A1 and the portions of the upper electrode 150*a* disposed in the edge regions A2 may be electrically connected to the first electrode pad 174*a*, and the portion of the upper electrode 150*a* disposed in the central region A1 and the portions of the lower electrode 130*a* disposed in the edge regions A2 may be electrically connected to the second electrode pad 174*b*.

As described above, the piezoelectric member 140*a* may be formed of a piezoelectric ceramic material such as AN, ZnO or PZT. The lower and upper electrodes 130*a* and 150*a* may be formed of a conductive material such as a metal. For example, the lower and upper electrodes 130*a* and 150*a* may be formed of gold (Au), titanium (Ti), tantalum (Ta), molybdenum (Mo), ruthenium (Ru), platinum (Pt), tungsten (W), aluminum (Al), nickel (Ni) or an alloy thereof. However, the lower and upper electrodes 130*a* and 150*a* may not necessarily need to be formed of the same material as each other.

The piezoelectric microspeaker 100 may also include the power unit 172, which generates a voltage for driving the piezoelectric actuators 20. The power unit 172 may use the power source of an electronic device in which the piezoelectric microspeaker 100 is installed or another power source. The piezoelectric microspeaker 100 may also include the first and second electrode pads 174*a* and 174*b*, which are connected to a pair of electrodes of the power unit 172. The shape and arrangement of the first and second electrode pads 174*a* and 174*b* shown in FIG. 1 are exemplary, and there is no specific limit on the shape and arrangement of the first and second electrode pads 174*a* and 174*b*. The first and second electrode pads 174*a* and 174*b* may be formed of a conductive metal. However, the first and second electrode pads 174*a* and 174*b* may not necessarily need to be formed of the same material as each other.

In short, the piezoelectric microspeaker 100 may include the diaphragm 10, which is divided into the piezoelectric actuating portions 120*a* and the piezoelectric non-actuating portions 162, and the piezoelectric actuating portions 120*a* may be divided into the central portion disposed in the central region A1 and the edge portions disposed in the edge regions A2. The central portion disposed in the region A1 may be free to vibrate without being restrained by the substrate 110*a*, whereas the edge portions disposed in the regions A2 are fixed partially onto the substrate 110*a* and can thus move like cantilevers. As a result, the diaphragm 10 can be moved by a large amount, and thus, the piezoelectric microspeaker 100 can provide high power output.

Figure 3:
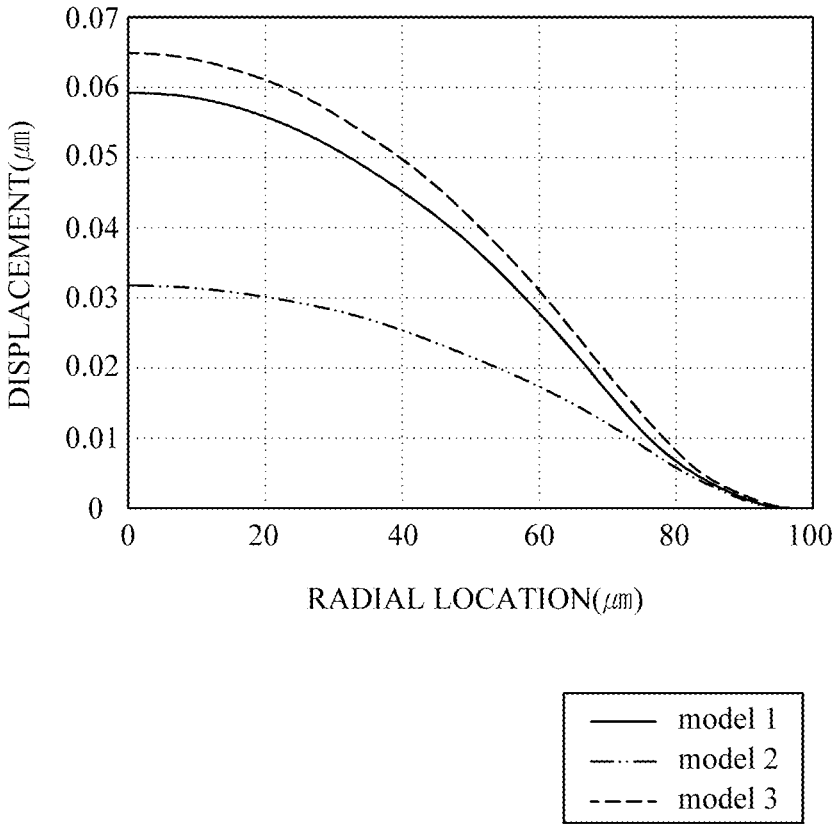
FIG. 3 is a graph illustrating the amounts of displacement, along a radial direction, of the diaphragms of three types of piezoelectric microspeakers according to an embodiment.

FIG. 3 is a graph illustrating the amounts of displacement, along a radial direction, of the following three piezoelectric microspeakers: model 1, which is a piezoelectric microspeaker having a diaphragm formed of a ceramic layer and a central actuator formed on the diaphragm, model 2, which is a piezoelectric microspeaker having a diaphragm formed of a ceramic layer and edge actuators formed on the diaphragm, and model 3, which is a piezoelectric microspeaker having a diaphragm formed of a ceramic layer and a central actuator and edge actuators formed on the diaphragm. More specifically, FIG. 3 illustrates displacement measurements obtained from various radial locations on the diaphragms of models 1 through 3 by applying a voltage of 3 V to the upper and lower electrodes of each of the actuators of each of models 1 through 3. Referring to FIG. 3, model 3, which, like the piezoelectric microspeaker 100, includes a central actuator and edge actuators surrounding the central actuator, undergoes the largest amount of displacement.

Table 1 shows center displacement measurements and displaced volume measurements obtained from models 1 through 3.

TABLE 1

| | Center Displacement | Displaced Volume |
|---|---|---|
| Model 1 | 59.5 nm (100%) | 666 $\mu m^3$ (100%) |
| Model 2 | 31.8 nm (53%) | 403 $\mu m^3$ (61%) |
| Model 3 | 65.1 nm (109%) | 742 $\mu m^3$ (111%) |

Referring to Table 1, percentages in parentheses are based on measurements obtained from model 1. Model 3, like the piezoelectric microspeaker 100 shown in FIG. 1 or FIG. 2, has about 50% greater center displacement and displaced volume than model 2.

FIGS. 4A through 4E are cross-sectional views illustrating an example of a method of fabricating the piezoelectric microspeaker 100. For convenience, the first and second electrode pads 174*a* and 174*b* of the piezoelectric microspeaker 100 are not shown in FIG. 4A through 4F. It would be obvious to one of ordinary skill in the art that the first and second electrode pads 174*a* and 174*b* may be formed during the formation of the lower and upper electrodes 130*a* and 150*a*.

Figure 4A:
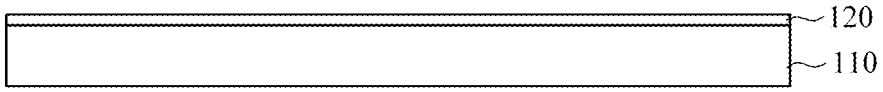
FIGS. 4A through 4E are cross-sectional views illustrating a method of fabricating the piezoelectric microspeaker shown in FIG. 2 according to an embodiment.
Figure 4B:
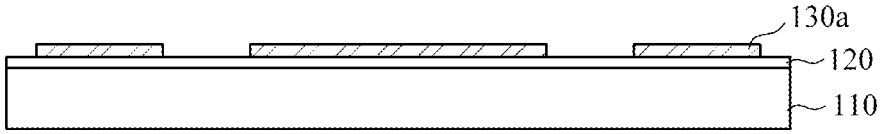

Referring to FIGS. 2 and 4A, a first insulating layer 120 may be formed on a substrate 110 (e.g., a Si substrate). The first insulating layer 120 may be formed of a ceramic material such as SiN. For example, the first insulating layer 120 may be formed as an SiN layer having a thickness of about 0.5-3 μm by using chemical vapor deposition (CVD). The first insulating layer 120 may be used to form the piezoelectric actuating portions 120*a*.

Thereafter, a series of processes for forming the piezoelectric actuators 20 may be performed on the first insulating layer 120. More specifically, referring to FIGS. 2 and 4B, the lower electrodes 130*a* may be formed on the first insulating layer 120. The lower electrodes 130*a* may be formed by depositing a first conductive layer using a conductive material such as Au, Ti, Ta, Mo, Ru, Pt, W, Al, Ni or an alloy thereof and partially etching the first conductive layer. The first conductive layer may be formed to a thickness of about 0.5-3 μm by using plating or physical vapor deposition (PVD) such as sputtering. Portions of the first conductive layer corresponding to the piezoelectric non-actuating portions 162 may be etched away, thereby completing the formation of the lower electrodes 130*a*.

Figure 4C:
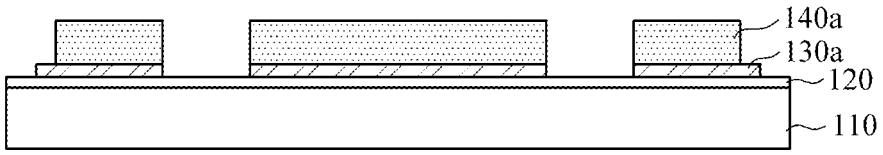

Referring to FIGS. 2 and 4C, the piezoelectric members 140*a* may be formed on the lower electrodes 130*a*. The piezoelectric members 140*a* may be formed by forming a piezoelectric layer on the substrate 110 using a piezoelectric ceramic material such as AN, ZnO or PZT and partially etching the piezoelectric layer. The piezoelectric layer may be formed to a thickness of about 1-5 μm by using chemical vapor deposition CVD or PVD (such as sputtering). Portions of the piezoelectric layer corresponding to the piezoelectric non-actuating portions 162 may be etched away, thereby completing the formation of the piezoelectric members 140*a*.

Figure 4D:
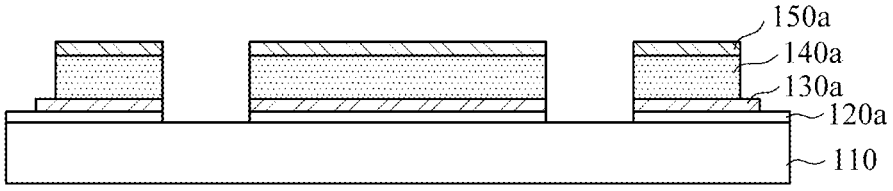

Referring to FIGS. 2 and 4D, the upper electrodes 150*a* may be formed on the piezoelectric members 140*a*, and portions of the first insulating layer 120 corresponding to the piezoelectric non-actuating portions 162 may be removed. As a result, only portions of the first insulating layer 120 corresponding to the central portion in the region A1 and the edge portions in the regions A2 may remain on the substrate 110*a*, and the substrate 110 may be exposed between the remaining portions of the first insulating layer 120. The upper electrodes 150*a* may be formed by depositing a second conductive layer using a conductive material such as Au, Ti, Ta, Mo, Ru, Pt, W, Al, Ni or an alloy thereof and partially etching the second conductive layer. The second conductive layer may be formed to a thickness of about 0.5-3 μm by using plating or PVD such as sputtering. Portions of the second conductive layer corresponding to the piezoelectric non-actuating portions 162 may be etched away, thereby completing the formation of the upper electrodes 150*a*.

Figure 4E:
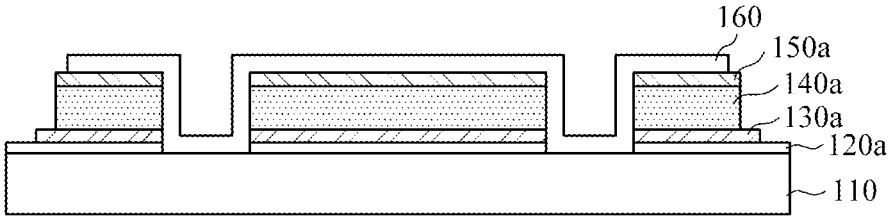

Thereafter, referring to FIGS. 2 and 4E, a second insulating layer 160 may be formed on the entire surface of the substrate 110. More specifically, the second insulating layer 160 may be a polymer membrane formed by depositing a polyimide such as parylene to a thickness of about 0.5-10 μm. Portions of the second insulating layer 160 along the edges of the substrate 110 may be removed, if necessary, using nearly all kinds of methods available.

Thereafter, the bottom of the substrate 110 may be etched. As a result, referring to FIG. 2, the substrate 110*a* having the through hole 112 may be obtained, and the diaphragm 10 may be released from the substrate 110*a*.

Figure 5:
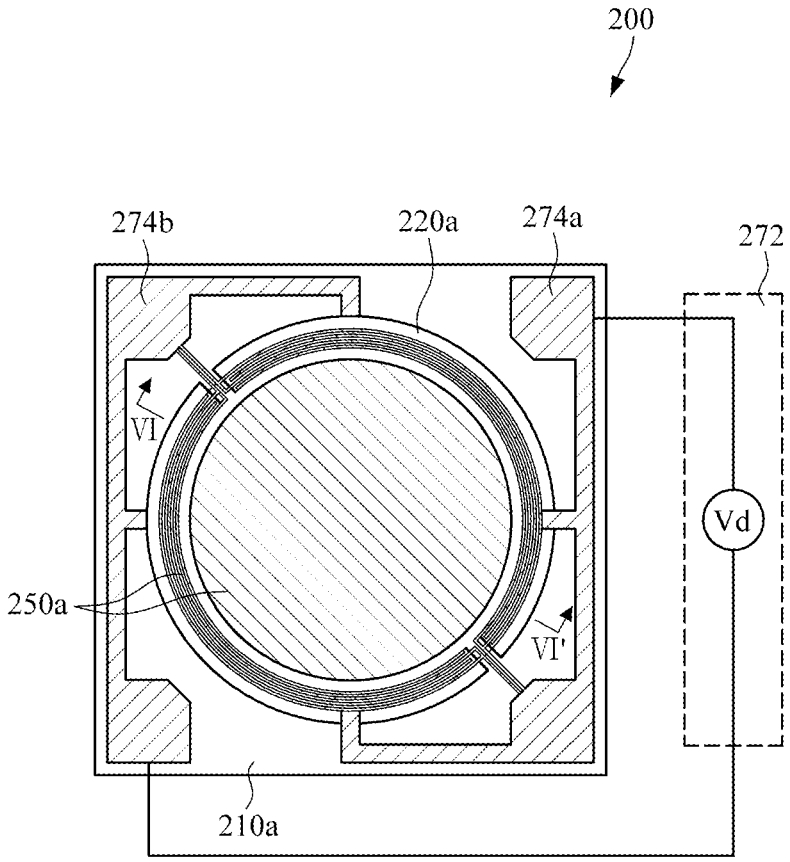
FIG. 5 is a diagram illustrating a piezoelectric microspeaker according to another embodiment.
Figure 6:
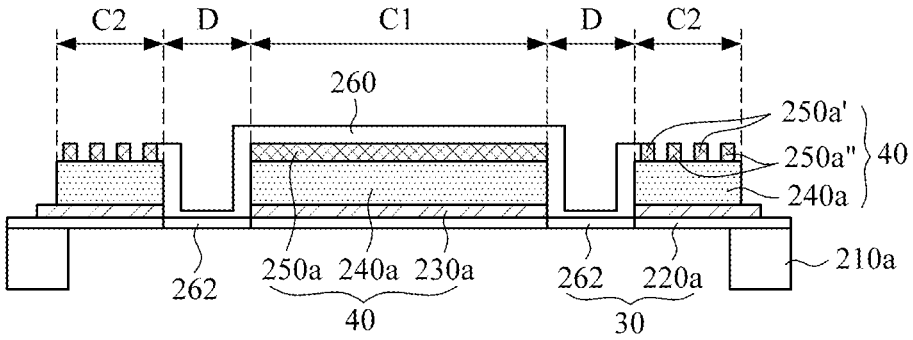
FIG. 6 is a cross-sectional view taken along line VI-VI' of FIG. 5.

FIG. 5 is a diagram illustrating another example of the piezoelectric microspeaker 100, i.e., a piezoelectric microspeaker 200, and FIG. 6 is a cross-sectional view taken along line VI-VI' of FIG. 5. Referring to FIGS. 5 and 6, the structure of the piezoelectric microspeaker 200 is almost the same as the structure of the piezoelectric microspeaker 100 shown in FIG. 1 or 2 in that the piezoelectric microspeaker 200 includes a substrate 210*a*, a diaphragm 30, and a plurality of piezoelectric actuators 40 and also includes a power unit 272 and a pair of first and second electrode pads 274*a* and 274*b*. Thus, the structure of the piezoelectric microspeaker 200 will hereinafter be described, focusing mainly on differences with the structure of the piezoelectric microspeaker 100.

Referring to FIGS. 5 and 6, the piezoelectric actuators 40 may include a central actuator formed on a central portion of the diaphragm 30 in central region C1 and a plurality of edge actuators formed on a plurality of edge portions of the diaphragm 30 formed in edge regions C2. The central actuator may include a pair of lower and upper electrodes 230*a* and 250*a* and a piezoelectric member 240*a* between the lower and upper electrodes 230*a* and 250*a*. That is, the central actuator, like the central actuator of the piezoelectric actuator 20 shown in FIG. 2, may have a stack including the lower electrode 230*a*, the piezoelectric member 240*a* and the upper electrode 250*a*. On the other hand, each of the edge actuators may include a lower electrode 230*a*, a piezoelectric member 240*a* and a plurality of pairs of upper electrodes (i.e., a pair of first upper electrodes 250*a*' and a pair of second upper electrodes 250*a*"), which apply an electric field to the piezoelectric member 240*a*. The first upper electrodes 250*a*' and the second upper electrodes 250*a*" may form a plurality of conductive lines together and may be alternately arranged on the piezoelectric member 240*a* in the shape of a comb.

Four conductive lines are illustrated in FIGS. 5 and 6 as the first and second upper electrodes 250*a*' and 250*a*", but they are not restricted to this. The first upper electrodes 250*a*' may be electrically connected to the first conductive pad 274*a*, and the second upper electrodes 250*a*" may be electrically connected to the second conductive pad 274*b*. Alternatively, the first upper electrodes 250*a*' may be electrically connected to the second conductive pad 274*b*, and the second upper electrodes 250*a*" may be electrically connected to the first conductive pad 274*a*.

A conductive layer, if any, formed below the piezoelectric member 240*a* of the central actuator or below the piezoelectric members 240*a* of the edge actuators does not serve an electrode. Thus, no conductive layer need be formed below the piezoelectric member 240*a* of the central actuator or below the piezoelectric members 240*a* of the edge actuators. However, a conductive layer may inevitably be formed under the piezoelectric member 240*a* of the central actuator during the formation of the lower electrode 230*a* of the central actuator. In this case, the conductive layer may be floated.

The piezoelectric microspeaker 200 may also include a polymer membrane 260. The polymer membrane 260 may be formed only on the central actuator because it is difficult to form the polymer membrane 260 on the edge actuators. However, the polymer membrane 260 may also be formed on the edge actuators.

Since no polymer membrane is formed on the edge actuators, the piezoelectric microspeaker 200 may be thinner, especially in the edge portions of the diaphragm 30 in the regions C2, than the piezoelectric microspeaker 100 shown in FIG. 1 or 2. Thus, the piezoelectric microspeaker 200 can be more flexible than the piezoelectric microspeaker 100, and can thus be applied to various applications.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A piezoelectric microspeaker comprising:

a substrate which has a through hole formed therein;

a diaphragm which is disposed on the substrate and covers the through hole; and a plurality of piezoelectric actuators that are separated from each other with portions of the diaphragm disposed between the plurality of piezoelectric actuators, wherein the plurality of piezoelectric actuators comprise a central actuator which is disposed on a central portion of the diaphragm, and a plurality of edge actuators which are disposed a predetermined distance apart from the central actuator and are formed on a plurality of edge portions of the diaphragm, and wherein the diaphragm comprises a plurality of actuating portions and a plurality of non-actuating portions between the plurality of actuating portions, each of the plurality of actuating portions comprising a first insulating portion, and each of the plurality of the non-actuating portions comprising a second insulating portion.

2. The piezoelectric microspeaker of claim 1, wherein each of the plurality of piezoelectric actuators comprises a piezoelectric member, a first electrode, and a second electrode, wherein the first and second electrodes are configured to induce an electric field in the piezoelectric member.

3. The piezoelectric microspeaker of claim 1, wherein the plurality of piezoelectric actuators are disposed on the plurality of actuating portions, and the plurality of non-actuating portions correspond to the portions of the diaphragm between the plurality of piezoelectric actuators.

4. The piezoelectric microspeaker of claim 3, wherein the first insulating portion comprises a ceramic film and the second insulating portion comprises a polymer membrane.

5. The piezoelectric microspeaker of claim 4, wherein the second insulating portion corresponds to a part of a polymer membrane which is disposed on the substrate and the piezoelectric actuators and which conforms to the shapes of the piezoelectric actuators.

6. The piezoelectric microspeaker of claim 1, wherein the plurality of edge actuators form a ring-shape and surround the central actuator.

7. The piezoelectric microspeaker of claim 6, wherein the edge portions of the diaphragm are cantilevers having outer circumferential sides fixed onto the substrate.

8. The piezoelectric microspeaker of claim 2, wherein each of the piezoelectric actuators comprises a stacked structure in which the first electrode, the piezoelectric member and the second electrode are sequentially stacked.

9. The piezoelectric microspeaker of claim 8, further comprising:

a power unit configured to generate a voltage for driving the piezoelectric actuators; and a pair of first and second electrode pads which are electrically connected to the power unit, wherein the first electrode of each of the piezoelectric actuators is electrically connected to the first electrode pad and the second electrode of each of the piezoelectric actuators is electrically connected to the second electrode pad.

10. The piezoelectric microspeaker of claim 8, further comprising:

a power unit configured to generate a voltage for driving the piezoelectric actuators; and a pair of first and second electrode pads which are electrically connected to the power unit, wherein the first electrode of the central actuator and the second electrode of each of the edge actuators are electrically connected to the first electrode pad and the second electrode of the central actuator and the first electrode of each of the edge actuators are electrically connected to the second electrode pad.

11. The piezoelectric microspeaker of claim 2, wherein the central actuator comprises a stacked structure in which the first electrode, the piezoelectric member and the second electrode are sequentially stacked and the edge actuators each comprise a structure in which the first and second electrodes are alternately arranged on the piezoelectric member in the shape of a comb.

12. The piezoelectric microspeaker of claim 11, further comprising:

a power unit configured to generate a voltage for driving the piezoelectric actuators; and a pair of first and second electrode pads which are electrically connected to the power unit, wherein the first electrode of each of the piezoelectric actuators is electrically connected to the first electrode pad and the second electrode of each of the piezoelectric actuators is electrically connected to the second electrode pad.

13. A piezoelectric microspeaker comprising:

a substrate having a through hole formed therein;

a diaphragm disposed on the substrate which overlaps the through hole and comprising a circumferential portion which is attached to the substrate surrounding the through hole, wherein the diaphragm comprises a ceramic layer;

a central piezoelectric actuator disposed on a central portion of the diaphragm over the through hole;

a plurality of edge actuators disposed on the diaphragm such that each of the plurality of edge actuators overlaps an inner edge of the substrate around the through hole, wherein the central piezoelectric actuator and the plurality of edge actuators are separated from each other with portions of the diaphragm disposed between the central piezoelectric actuator and the plurality of edge actuators, and wherein the diaphragm comprises a plurality of actuating portions and a plurality of non-actuating portions between the plurality of actuating portions, each of the plurality of actuating portions comprising a first insulating portion, and each of the plurality of non-actuating portions comprising a second insulating portion.

* * * * *